United States Patent [19]

Corlett

[11] Patent Number: 4,683,830

[45] Date of Patent: Aug. 4, 1987

[54] SHIP'S STEERING SYSTEMS

[75] Inventor: Ewan C. B. Corlett, Port'e Vullen, Isle of Man

[73] Assignee: Hydroconic Limited, England

[21] Appl. No.: 800,361

[22] Filed: Nov. 21, 1985

Related U.S. Application Data

[63] Continuation of Ser. No. 660,405, Oct. 12, 1984, abandoned, which is a continuation of Ser. No. 382,013, May 25, 1982, abandoned.

[30] Foreign Application Priority Data

May 29, 1981 [GB] United Kingdom ..... 8116570

[51] Int. Cl.[4] ..... B63H 25/06

[52] U.S. Cl. ..... 114/163; 114/169

[58] Field of Search ..... 114/162, 163, 165, 169

[56] References Cited

U.S. PATENT DOCUMENTS

| | | | |
|---|---|---|---|
| 253,226 | 2/1882 | Rees | 114/163 |
| 3,412,703 | 11/1968 | Clark et al. | 114/163 |
| 3,580,208 | 5/1971 | Hinckley | 114/163 |
| 3,606,852 | 9/1971 | Cafiero | 114/163 |

*Primary Examiner*—Joseph F. Peters, Jr.
*Assistant Examiner*—Thomas J. Brahan
*Attorney, Agent, or Firm*—Hall, Myers & Rose

[57] ABSTRACT

A rudder system is provided on a vessel with an open propeller or no propeller, comprising at least three rudders coupled to turn in unison and operating as a cascade. The rudders are mounted on stocks journalled in bearings carried by a box above the rudder which box is fitted into a recess in the hull. A master tiller is provided on the center stock, and the three stocks are coupled to one another within the box.

3 Claims, 3 Drawing Figures

SHIP'S STEERING SYSTEMS

Figure 1:
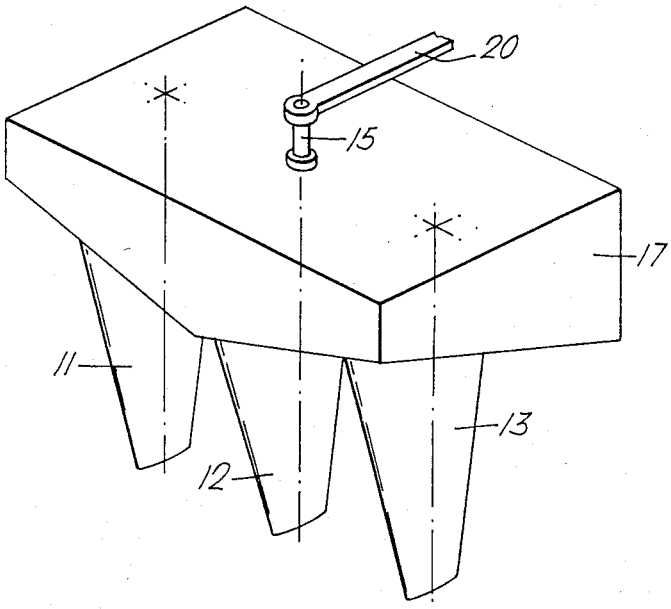

This is a continuation of application Ser. No. 660,405, filed Oct. 12, 1984 which is a continuation of Ser. No. 382,013 filed May 25, 1982 now abandoned.

This invention relates to ship's steering systems.

The rudder system of a ship generally consists of a single blade aft of a propeller which may be in a nozzle or propulsion duct or may be open. The single rudder behind a propeller may be replaced by several rudders, a fairly common arrangement being two fairly well spaced apart rudders working together. In British Patent Specifications Nos. 1131611, 1174231, 1241764, 1342472 and 8113379 there are described various arrangements of ducted propeller propulsion system in which three or more comparatively closely spaced rudders work together as a cascade at the exit of a nozzle or propulsion duct surrounding the propeller.

For a given total area and with the rudders geometrically similar, as an example, the steering torque varies inversely as the square root of the number of blades, while if the span of the rudders is maintained constant, the torque becomes inversely proportional to the number of blades, being lower in both cases the higher the number of blades.

Although with a cascade of blades the individual blade lift coefficient is slightly reduced at a given aspect ratio, it is possible to use a high aspect ratio for each individual blade and yet avoid early stall because of the cascade effect. Thus, large steering angles are possible with such rudders, associated with high lift coefficients.

Furthermore, the balance of the individual rudders may be adjusted so that, for instance in the case of three rudders, the two wing rudders can be heavily overbalanced in the zero steering angle, ahead condition and the centreline rudder heavily underbalanced. By this means it is possible to produce in a given case a distribution of steering torque against rudder angle that suits a particular steering requirement or application.

Such rudder systems aft of a duct can be small, light and cheap, can produce high steering lifts for very low steering torques and additionally can have a desirable propulsive effect derived from greater reduction of the residual rotary component of the propeller race as compared with the reduction achieved by a single rudder aft of the propeller.

According to the present invention, a rudder system comprising at least three rudder blades ganged to turn together and acting in cascade is fitted behind an open propeller or on a vessel having no propeller at all.

In a specific embodiment, particularly applicable to non-metal hulls, e.g. of wood or glass-reinforced plastics material (GRP), but also applicable to those of metal construction, three shutter rudders are mounted on a separate box which may be bolted into a recess in the hull. The box may be either free-flooding or watertight and the stock of the centre rudder of the three penetrates right through the box with a gland at the top, a master tiller for the rudder set being mounted on the stock above the gland. Inside the box, there are three subsidiary tillers and links linking the two wing rudders with the centre rudder. The box may be made of GRP or aluminium or other suitable, non-corrodible material, the rudder stocks of stainless steel or some similar material, and the rudders may be one-piece mouldings that are moulded around the rudder stocks, the material being a synthetic plastics foam of high strength such as a 20% by weight microballoon resin mix.

In the design of such a system for a particular application, the starting point is the number of turns required from hard over to hard over on the steering gear and the helm spoke force. For slow speed work the rudder system may use large angles of helm and may be fitted with a simple blocking gear, which may be a pin operable from the steering position, to prevent these large angles being used at high speed. The lateral 'lift' required at low speed is thus provided not by excess rudder area but by extra helm angle not employed at higher speeds, the area of the rudder system and its lift at high speed being determined from the desired lift characteristics. The rudder torque on the master stock of each system is determined by the speed of the vessel, the area of the rudders and the helm angle, and also by the relative balance between the two wing rudders on the one hand and the centre rudder on the other. Thus, the torque and 'lift' of the rudder system may be made to some extent independent of each other, as may the required helm angle for low speed operation and that for high speed.

Figure 2:
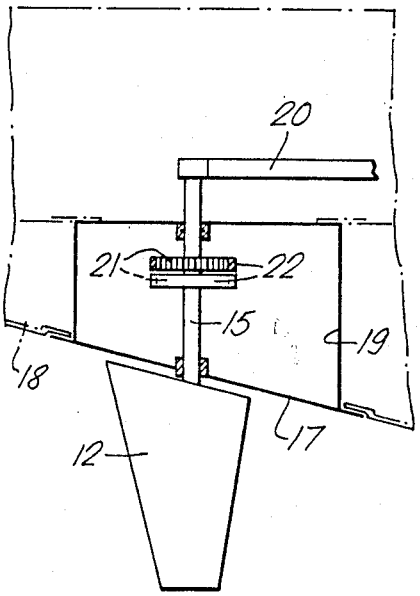
Figure 3:
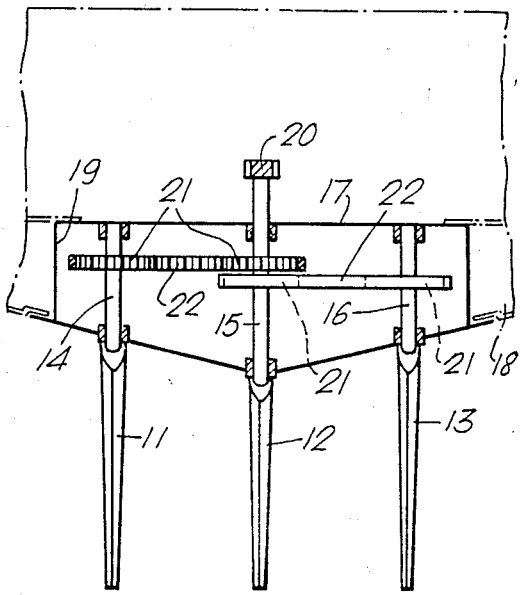

One arrangement according to the invention will now be described by way of example, with reference to the accompanying drawings, in which:

FIG. 1 is a diagrammatic pictorial view of a rudder system according to the invention, FIG. 2 is a diagrammatic side elevation, and FIG. 3 is a diagrammatic section rear elevation.

In the drawings, three rudders 11, 12, 13 ganged to operate as a cascade are carried on stocks 14, 15, 16 journalled in bearings mounted on the top and bottom walls of a box 17 that is fitted into a recess 19 in the hull 18 of a ship aft of the propeller (not shown). The stock 15 of the central rudder 12 extends above the box 17 and has mounted on it a master tiller 20. The three stocks 14, 15 and 16 are coupled to turn together by gears 21 and cogged belts 22.

The system may be applied to non-propeller driven vessels as well, such as sailing yachts. In this case, with the larger and faster vessels and a single rudder, it becomes impossible to employ tiller steering and a wheel has to be used to control the large rudder forces. With use of the invention, the steering system may revert to tiller steering even for the largest and fastest sailing vessels and thereby restore the sensitivity of control that is considered to be essential by many sailors and which is provided in smaller sizes of vessel by the tiller.

I claim:

1. A modular rudder assembly, adapted to be fastened to non-metal boat hulls having a recessed area and with unducted propellers, comprising:

a unitary box complementary to and adapted to be removably secured to the boat hull recess, said box having enclosing side, top and bottom walls;

an athwartships row of at least three rotatable rudder stocks having lower portions extending below said bottom wall and upper portions extending above the bottom wall and into the interior of said box at least one of said rudder stocks also extending through and projecting above said top wall of said box, the lower portions of said rudder stocks extending below the bottom wall of said box being cantilevered in that they are unsupported at their bottom ends;

bearings on said box in which the upper portions of said rudder stocks are journalled for rotation;

at least three rudder blades situated underneath said box and arranged as a cascade, each rudder blade being mounted on the lower portion of a respective one of said rudder stocks and being made as a one-piece molding of synthetic plastic material at least three gears in the interior of said box, one each affixed to each of said stocks said stocks and each having a cross-sectional area substantially greater than that of each of said stocks, and each gear having a plurality of teeth along its peripheral annular surface;

cogged belts having teeth complementary to and adapted to engage said gear teeth, one belt extending between and around at least two of said gears; and a pivotal main tiller arm above said box secured to the rudder stock that projects above said top wall where upon pivoting, said main tiller arm pivots said rudder stock and gear affixed thereto, imparting through said belt, gears, rudder stock and rudder blades an equal amount of rotational force thereby causing said blades to rotate in a substantially equivalent manner.

2. A modular rudder assembly according to claim 1 wherein the rudder blades are three in number and comprise a centre rudder flanked by two wing rudders, and said rudder stock that projects up through the top wall of the box to receive the main tiller arm is the stock of the centre rudder.

3. A modular rudder assembly as in claim 1 wherein said entire assembly is free-flooding.

* * * * *